US008651826B2

(12) United States Patent
Futakuchi et al.

(10) Patent No.: US 8,651,826 B2
(45) Date of Patent: Feb. 18, 2014

(54) VOLUME CONTROL VALVE

(75) Inventors: Masayuki Futakuchi, Tokyo (JP); Ryosuke Cho, Tokyo (JP); Kohei Fukudome, Tokyo (JP)

(73) Assignee: Eagle Industry Co., Ltd. (JP)

( * ) Notice: Subject to any disclaimer, the term of this patent is extended or adjusted under 35 U.S.C. 154(b) by 171 days.

(21) Appl. No.: 13/500,302

(22) PCT Filed: Feb. 22, 2011

(86) PCT No.: PCT/JP2011/053810
§ 371 (c)(1),
(2), (4) Date: Apr. 4, 2012

(87) PCT Pub. No.: WO2011/114841
PCT Pub. Date: Sep. 22, 2011

(65) Prior Publication Data

US 2012/0198992 A1 Aug. 9, 2012

(30) Foreign Application Priority Data

Mar. 16, 2010 (JP) ..... 2010-059895

(51) Int. Cl.
*F04B 1/29* (2006.01)
*F01B 3/02* (2006.01)

(52) U.S. Cl.
USPC ..... 417/222.2; 91/483; 91/505

(58) Field of Classification Search
CPC ..... F04B 27/1804; F04B 27/18; F04B 2027/1813; F04B 2027/1804; F04B 2027/1809; F04B 49/125; F04B 1/324; F04B 3/106; F03C 1/0686; F01B 3/102
USPC ..... 417/270, 271, 222.2, 222.1; 91/473, 91/482, 483, 504, 505; 137/596.17, 596.1
See application file for complete search history.

(56) References Cited

U.S. PATENT DOCUMENTS 6,354,811 B1 3/2002 Ota et al. ..... 417/222.2
6,435,848 B1 * 8/2002 Minami et al. ..... 417/440

(Continued)

FOREIGN PATENT DOCUMENTS

CN 101410620 4/2009 ..... F04B 27/14
EP 1099852 5/2001 ..... F04B 27/18

(Continued)

OTHER PUBLICATIONS

International Search Report for corresponding appln. No. PCT/JP2011/053810, dated May 24, 2011 (1 pg).

(Continued)

*Primary Examiner* — Bryan Lettman
(74) *Attorney, Agent, or Firm* — Hayes Soloway P.C.

(57) ABSTRACT

A capacity control valve capable of enhancing the function of discharging liquid refrigerant in a control chamber during startup of a variable capacity compressor, and improving the control speed of a swash plate during control is provided. The valve has an adapter that has an annular bearing surface and is provided to a free end of a pressure-sensitive body in the elongation and constriction direction, and a valve body for discharging liquid refrigerant, moveably provided inside the adapter. A slit is provided to an engaging part of the adapter with a third valve part, and an introduction hole for causing the control chamber pressure to act on a bottom surface of the valve body for discharging the liquid refrigerant is provided to the base part side, and an urging force is provided whereby the valve body for discharging the liquid refrigerant is urged in a valve-opening direction away from the third valve part.

4 Claims, 9 Drawing Sheets

(56) References Cited

U.S. PATENT DOCUMENTS

| | | | | |
|---|---|---|---|---|
| 6,772,990 | B2 * | 8/2004 | Sasaki et al. | 251/129.03 |
| 8,251,673 | B2 * | 8/2012 | Taguchi | 417/222.2 |
| 2009/0183786 | A1 * | 7/2009 | Iwa et al. | 137/487.5 |
| 2011/0091334 | A1 * | 4/2011 | Taguchi et al. | 417/222.1 |
| 2012/0198993 | A1 * | 8/2012 | Fukudome et al. | 91/505 |

FOREIGN PATENT DOCUMENTS

| | | | |
|---|---|---|---|
| EP | 1852606 | 11/2007 | F04B 27/18 |
| EP | 1995460 | 11/2008 | F04B 27/14 |
| JP | 2001132632 | 5/2001 | F04B 27/14 |
| JP | 2007064028 | 3/2007 | F04B 27/14 |
| WO | WO2006090760 | 8/2006 | F04B 27/18 |
| WO | WO2007119380 | 10/2007 | F04B 27/14 |

OTHER PUBLICATIONS

PCT Notification of Transmittal of Translation of the International Preliminary Report on Patentability for application No. PCT/JP2011/053810, dated Nov. 1, 2012 (6 pgs).

* cited by examiner (a) DURING STARTUP {(Pc - Ps) < ΔP}

(b) DURING REGULAR CONTROL AND MAXIMUM CAPACITY OPERATION {(Pc - Ps) < ΔP}

(C) DURING REGULAR CONTROL AND MINIMUM CAPACITY OPERATION {(Pc - Ps) > ΔP}

Prior Art 1

Prior Art 2

VOLUME CONTROL VALVE

TECHNICAL FIELD

The present invention relates to a capacity control valve for variably controlling the capacity or pressure of a working fluid; and particularly relates to a capacity control valve for controlling, in accordance with the pressure load, the discharge rate of a variable capacity compressor or the like used in the air-conditioning system of a motor vehicle or the like.

BACKGROUND ART

A variable capacity swash plate compressor used in the air-conditioning system of a motor vehicle or the like is provided with a rotating shaft rotatably driven by the rotational force of the engine, a swash plate linked to the rotating shaft so that the angle of inclination can be varied, a compression piston linked to the swash plate, and the like. In the compressor, the stroke of the piston is varied by varying the angle of inclination of the swash plate to control the discharge rate of the coolant gas.

The angle of inclination of the swash plate can be continuously varied by appropriately controlling the pressure inside the control chamber and adjusting the state of balance of the pressure acting on both surfaces of the piston. This is achieved using a capacity control valve opened and closed by electromagnetic force while applying the suction pressure of the suction chamber for drawing in the coolant gas, the discharge pressure of the discharge chamber for discharging the coolant gas pressurized by the piston, and the control chamber pressure of the control chamber (crank chamber) for accommodating the swash plate.

Such capacity control valves are known to be provided, as shown in FIG. 8, with discharge-side passages 73, 77 for providing communication between the discharge chamber and the control chamber; a first valve chamber 82 formed in the middle of the discharge-side passage; suction-side passages 71, 72 for providing communication between the suction chamber and the control chamber; a second valve chamber (operating chamber) 83 formed in the middle of the suction-side passage; a valve body 81 formed so that a first valve part 76 disposed in the first valve chamber 82 and used for opening and closing the discharge-side passages 73, 77, and a second valve part 75 disposed in the second valve chamber 83 and used for opening and closing the suction-side passages 71, 72 are reciprocating in an integral manner at the same time as performing opening and closing in opposite directions of each other; a third valve chamber (capacity chamber) 84 formed in the middle of the suction-side passages 71, 72 nearer the control chamber; a pressure-sensitive body (bellows) 78 disposed in the third valve chamber, and used for exerting an urging force in the elongating (expanding) direction and undergoing constriction in accordance with an increase in the surrounding pressure; a valve seat body (engaging part) 80 provided to a free end of the pressure-sensitive body in the elongation direction, the valve seat body having an annular bearing surface; a third valve part (valve-opening linkage) 79 integrally moving with the valve body 81 in the third valve chamber 84 and having the capability to open and close the suction-side passages by engaging with and disengaging from the valve seat body 80; a solenoid S for exerting electromagnetic driving force on the valve body 81, and the like (hereinafter referred to as "Prior Art 1"; for example, refer to Patent Document 1).

In the capacity control valve 70, in cases in which the control chamber pressure must be changed during capacity control even though a crank structure is not provided in the variable capacity compressor, the discharge chamber and the control chamber can be made to communicate with each other, and the pressure (control chamber pressure) Pc in the control chamber can be adjusted. An arrangement is also possible in which the third valve part (valve-opening linkage) 79 is disengaged from the valve seat body (engaging part) 80 to open the suction-side passages and to provide communication between the suction chamber and the control chamber in cases in which the control chamber pressure Pc increases while the variable capacity compressor is in a stopped state.

Liquid refrigerant (the coolant gas cooled and liquefied during the period of idleness) accumulates in the control chamber (crank chamber) in cases such as those in which the variable capacity swash plate compressor is stopped and then restarted after a long period of idleness. Therefore, the coolant gas cannot be compressed and the discharge rate cannot be maintained at the set level as long as the liquid refrigerant is not discharged.

The liquid refrigerant of the control chamber (crank chamber) must be discharged as quickly as possible immediately after startup to perform the desired capacity control.

When the solenoid S is first turned off and the variable capacity compressor is left in a stopped state for a long time while the second valve part 75 is blocking the communication passages (suction-side passages) 71, 72 in the capacity control valve 70 of Prior Art 1, a state arises in which the liquid refrigerant accumulates in the control chamber (crank chamber) of the variable capacity compressor. In cases in which the variable capacity compressor is stopped for a long period of time, the interior of the variable capacity compressor achieves a uniform pressure, and the control chamber pressure Pc rises substantially above the control chamber pressure Pc and the suction pressure Ps during operation of the variable capacity compressor.

When the solenoid S is turned on and the valve body 81 is started up in this state, the first valve part 76 moves in the closing direction at the same time as the second valve part 75 moves in the opening direction, and the liquid refrigerant in the control chamber of the variable capacity compressor is discharged. The control chamber pressure Pc then constricts the pressure-sensitive body 78, and the third valve part 79 is disengaged from the valve seat body 80 and opened. The state at this time is such that the second valve part 75 opens to open the communication passages (suction-side passages) 72, 71, and the liquid refrigerant inside the control chamber is therefore discharged to the suction chamber of the variable capacity compressor through the communication passages (suction-side passages) 74, 72, 71. When the control chamber pressure Pc reaches or decreases below a preset level, the pressure-sensitive body 78 elastically recovers and elongates, the valve seat body 80 engages with the third valve part 79 and closes, and the communication passages (suction-side passages) 74, 72, 71 are blocked.

However, in Prior Art 1, the structure is such that the pressure-sensitive body 78 is constricted and the third valve part 79 is disengaged from the valve seat body 80 and opened. Problems therefore arise in that the length of the pressure-sensitive body 78 must be increased and other actions taken to increase the opening-valve stroke, and increasing the opening-valve stroke is difficult to accomplish. Specifically, although the capacity control valve of Prior Art 1 can discharge the liquid refrigerant faster than a conventional capacity control valve not configured to be able to open the third valve part 79 (a capacity control valve for discharging the coolant via only a fixed orifice that provides direct communication between the control chamber and the suction chamber), there are limits to the discharge performance.

In view of this, a device provided with a supplementary communication passage 85 on the lateral surface of the third valve part 79 has been proposed by the present inventors (hereinafter referred to as "Prior Art 2"; for example, refer to Patent Document 2), as shown in FIG. 9.

The device of Prior Art 2 has the ability to more quickly discharge the liquid refrigerant and more efficiently discharge pressure during maximum capacity, but problems arise in that flow from the control chamber (crank chamber) to the suction chamber is produced during operation because of a state in which the control chamber (crank chamber) and suction chamber are in constant communication with each other, and the control speed of the swash plate is adversely affected during control of the variable capacity compressor.

FIG. 6 is an explanatory view describing the aperture surface area of the fixed orifice (hereinafter simply referred to as "fixed orifice") in direct communication with the control chamber and the suction chamber in the above-described Prior Art 1, Prior Art 2, and the present invention; and the aperture surface area of the communication passages (suction-side passages 74, 72, 71) formed from the supplementary communication passage and aperture parts of the third valve part and the valve seat body.

A description will now be given with particular reference to Prior Art 1 and Prior Art 2. For the sake of convenience, s1 in this description is the aperture surface area of the fixed orifice, s2 is the aperture surface area of the third valve part 79 and the valve seat body 80, and s3 is the aperture surface area of the supplementary communication passage 85.

In Prior Art 1, the sum s1+s2 is the aperture surface area during discharge of the liquid refrigerant, and s1 is the aperture surface area during maximum capacity operation, regular control, and minimum capacity operation (hereinafter occasionally referred to collectively as "during control").

In contrast, an object of Prior Art 2 is to increase the aperture surface area during discharge of the liquid refrigerant, and the aperture surface area during discharge of the liquid refrigerant is increased to s1+s2+s3 by providing the supplementary communication passage 85. However, the supplementary communication passage 85 is constantly open during operation, and the aperture surface area during regular control is therefore also increased to s1+s3. Increasing the aperture surface area during regular control creates the problem that the variation in control chamber pressure Pc relative to the variation in suction pressure Ps is slow, reducing the control speed of the swash plate during regular control. Therefore, the increase in the aperture surface area s1+s3 during regular control is prevented in Prior Art 2 by increasing the aperture surface area s1+s2+s3 during discharge of the liquid refrigerant and reducing the aperture surface area s1 of the fixed orifice as compared with Prior Art 1.

PRIOR ART DOCUMENTS

Patent Documents

Patent Document 1: WO 2006/090760
Patent Document 2: WO 2007/119380

DISCLOSURE OF THE INVENTION

Problems to Be Solved by the Invention

The increase in the aperture surface area s1+s3 during regular control is prevented in the above-described Prior Art 2, but the aperture surface area during regular operation is greater than in Prior Art 1, as shown in FIG. 6. It is therefore unavoidable that the variation in control chamber pressure Pc relative to the variation in suction pressure Ps is slower than in Prior Art 1, as shown by the dashed line in FIG. 7, and the problem of the lower control speed of the swash plate during control cannot be resolved.

The present invention was devised in order to solve the problems in Prior Art 1 and 2, and an object of the present invention is to provide a capacity control valve capable of maintaining an enhanced state for the function (aperture surface area during the discharge of liquid refrigerant according to Prior Art 2 in FIG. 6) to discharge the liquid refrigerant in the control chamber during startup of the variable capacity compressor, capable of maintaining an enhanced state for the pressure discharge efficiency (aperture surface area during maximum capacity according to Prior Art 2 in FIG. 6) during maximum capacity, and capable of improving the control speed (aperture surface area during regular control according to Prior Art 2 in FIG. 6) of the swash plate during regular control (between maximum capacity operation and minimum capacity operation) and during minimum capacity operation.

Means to Solve the Aforementioned Problems

Aimed at achieving the aforementioned object, the capacity control valve according to a first aspect of the present invention is characterized in comprising: a discharge-side passage for providing communication between a discharge chamber for discharging a fluid and a control chamber for controlling the discharge rate of the fluid;

a first valve chamber formed in the middle of the discharge-side passage;

a suction-side passage for providing communication between a suction chamber for drawing in the fluid and the control chamber;

a second valve chamber formed in the middle of the suction-side passage;

a valve body integrally having a first valve part for opening and closing the discharge-side passage in the first valve chamber and a second valve part for opening and closing the suction-side passage in the second valve chamber, and performing an operation in which opening and closing occur opposite to each other by reciprocation thereof;

a third valve chamber formed nearer to the control chamber and away from the second valve chamber in the middle of the suction-side passage;

a pressure-sensitive body disposed in the third valve chamber, the pressure-sensitive body exerting an urging force in a direction for opening the first valve part by elongation, and undergoing constriction in accordance with an increase in the surrounding pressure;

an adapter provided to a free end of the pressure-sensitive body in the elongation and constriction direction, the adapter having an annular bearing surface;

a valve body for discharging a liquid refrigerant, moveably provided inside the adapter;

a third valve part having an annular engaging surface for integrally moving with the valve body in the third valve chamber and opening and closing the suction-side passage by engagement with and disengagement from the bearing surface of the adapter and the valve body for discharging the liquid refrigerant; and a solenoid for exerting an electromagnetic driving force on the valve body in a direction for closing the first valve part;

wherein a slit is provided to an engaging part of the adapter with the third valve part, an introduction hole for causing the control chamber pressure to act on a bottom surface of the valve body for discharging the liquid refrigerant is provided to the base part side, and urging means is provided whereby the valve body for discharging the liquid refrigerant is urged in a valve-opening direction away from the third valve part.

According to the first aspect, an enhanced state can be maintained for the function to discharge the liquid refrigerant in the control chamber during startup of the variable capacity compressor, an enhanced state can be maintained for the pressure discharge efficiency during maximum capacity, and the control speed of the swash plate during regular control and minimum capacity operation can be improved.

Secondly, the capacity control valve according to a first aspect of the present invention is characterized in that a contact surface that the valve body for discharging the liquid refrigerant has with the third valve part is formed in a tapered shape.

According to the second aspect, the seal diameter between the valve body for discharging the liquid refrigerant and the third valve part can be adjusted.

Thirdly, the capacity control valve according to a first or second aspect of the present invention is characterized in that a Y-ring is mounted to an external periphery of the valve body for discharging the liquid refrigerant, and the space between the valve body and the inner surface of the adapter is sealed.

According to the third aspect, the effect of the pressure difference between the control chamber pressure Pc and the suction chamber pressure Ps can be applied to the maximum.

Effect of the Invention

The present invention achieves the following remarkable effects.

(1) An enhanced state can be maintained for the function to discharge the liquid refrigerant in the control chamber during startup of the variable capacity compressor, an enhanced state can be maintained for the pressure discharge efficiency during maximum capacity, and the control speed of the swash plate during regular control and minimum capacity operation can be improved by providing:

an adapter provided to a free end of the pressure-sensitive body in the elongation and constriction direction, the adapter having an annular bearing surface, and a valve body for discharging a liquid refrigerant, moveably provided inside the adapter;

wherein a slit is provided to an engaging part of the adapter with the third valve part, an introduction hole for causing the control chamber pressure to act on a bottom surface of the valve body for discharging the liquid refrigerant is provided to the base part side, and urging means is provided whereby the valve body for discharging the liquid refrigerant is urged in a valve-opening direction away from the third valve part.

(2) The seal diameter between the valve body for discharging the liquid refrigerant and the third valve part can be adjusted by forming a contact surface that the valve body for discharging the liquid refrigerant has with the third valve part in a tapered shape.

(3) The effect of the pressure difference between the control chamber pressure Pc and the suction chamber pressure Ps can be applied to the maximum by mounting a Y-ring to an external periphery of the valve body for discharging the liquid refrigerant, and sealing the space between the valve body and the inner surface of the adapter.

BEST MODE FOR CARRYING OUT THE INVENTION

The modes of working the capacity control valve according to the present invention are described in detail with reference to the drawings, but various changes, modifications, and improvements are possible within the scope of the present invention based on the knowledge of one skilled in the art, without limiting the interpretation of the present invention.

Figure 1:
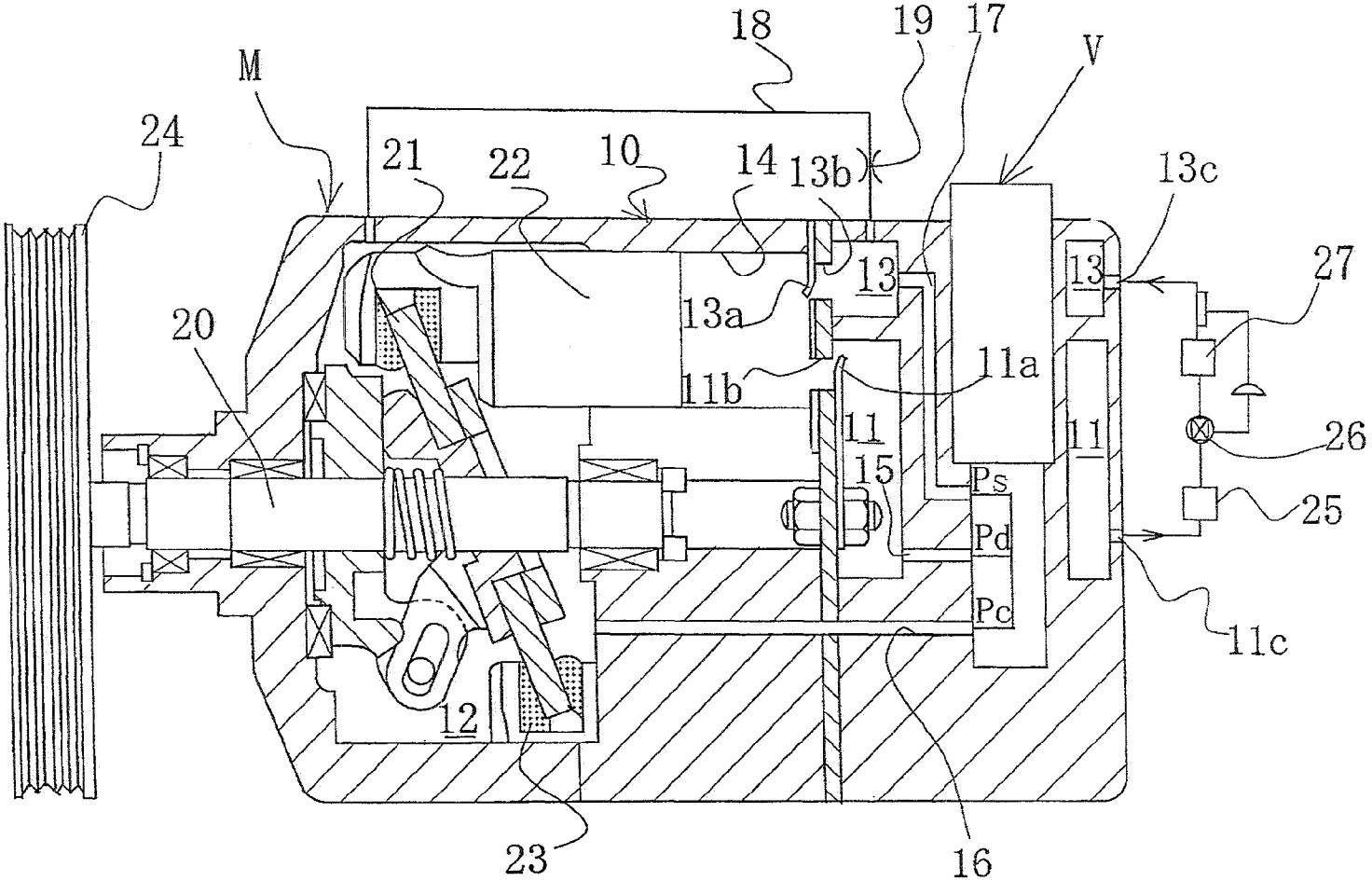
FIG. 1 is a schematic structural view showing a variable capacity swash plate compressor provided with the capacity control valve according to the present invention.

A variable capacity swash plate compressor M is provided with a discharge chamber 11; a control chamber (also referred to as a crank chamber) 12; a suction chamber 13; a plurality of cylinders 14; a port 11*b* opened and closed by a discharge valve 11*a* and used to provide communication between the cylinders 14 and the discharge chamber 11; a port 13*b* opened and closed by a suction valve 13*a* and used to provide communication between the cylinders 14 and the suction chamber 13; a discharge port 11*c* and a suction port 13*c* connected to an external cooling circuit; a communication passage 15 used as a discharge-side passage for providing communication between the discharge chamber 11 and the control chamber 12; a communication passage 16 doubling as the aforementioned discharge-side passage and as a suction-side passage for providing communication between the control chamber 12 and the suction chamber 13; a casing 10 for defining a communication passage 17 or the like as a suction-side passage; a rotating shaft 20 rotatably provided so as to protrude from the inside of the control chamber (crank chamber) 12 to the outside; a swash plate 21 integrally rotated with the rotating shaft 20 and linked to the rotating shaft 20 so that the angle of inclination can be varied; a plurality of pistons 22 fitted in a reciprocating manner inside each of the cylinders 14; a plurality of linking members 23 for linking each of the pistons 22 with the swash plate 21; a driven pulley 24 attached to the rotating shaft 20; a capacity control valve V of the present invention incorporated into the casing 10; and the like, as shown in FIG. 1.

In addition, a communication passage 18 for direct communication between the control chamber (crank chamber) 12 and the suction chamber 13 is provided to the variable capacity swash plate compressor M, and a fixed orifice 19 is provided to the communication passage 18.

Moreover, the cooling circuit is connected to the discharge port 11*c* and the suction port 13*c* in the variable capacity swash plate compressor M, and a condenser (condensing device) 25, an expansion valve 26, and an evaporator (evaporating device) 27 are provided in a sequential arrangement to the cooling circuit.

Figure 2:
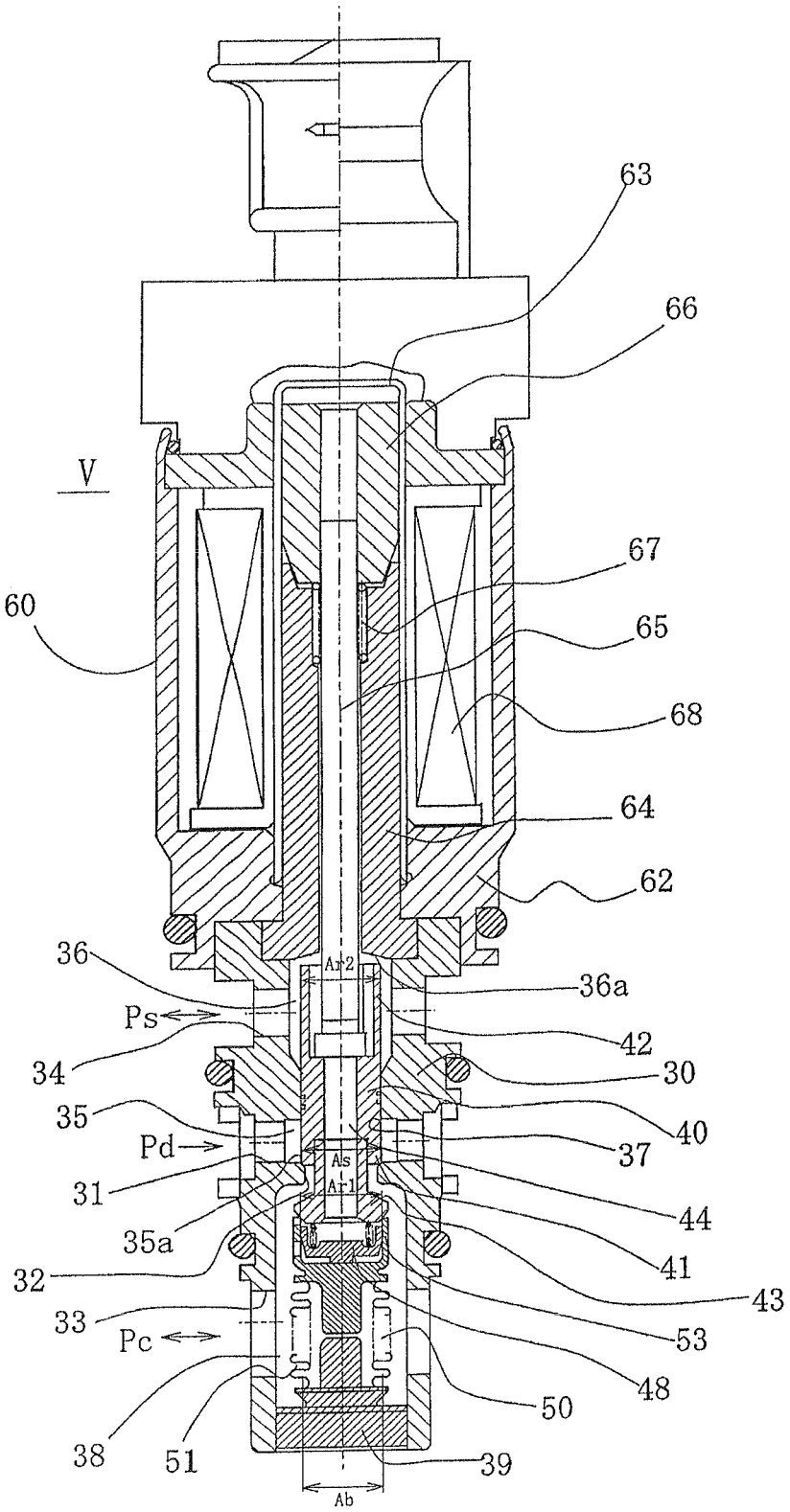
FIG. 2 is a front cross-sectional view showing an embodiment of the capacity control valve according to the present invention.

The capacity control valve V is provided with a body 30 formed from a metal material or a resin material, a valve body 40 disposed in a reciprocating manner inside the body 30, a pressure-sensitive body 50 for urging the valve body 40 in one direction, a solenoid 60 connected to the body 30 and used to exert an electromagnetic driving force on the valve body 40, and the like, as shown in FIG. 2.

The body 30 is provided with communication passages 31, 32, 33 functioning as discharge-side passages, communication passages 33, 34 functioning as suction-side passages together with a below-described communication passage 44 of the valve body 40, a first valve chamber 35 formed in the middle of the discharge-side passage, a second valve chamber 36 formed in the middle of the suction-side passage, a guide passage 37 for guiding the valve body 40, a third valve chamber 38 formed near the control chamber 12 of the discharge-side passage and the suction-side passage, and the like. In addition, a blocking member 39 that defines the third valve chamber 38 and constitutes a part of the body 30 is attached to the body 30 by threadable engagement.

Specifically, the communication passage 33 and the third valve chamber 38 are formed so as to double as a part of the discharge-side passage and the suction-side passage, and the communication passage 32 forms a valve hole for providing communication between the first valve chamber 35 and the third valve chamber 38 and accommodating the valve body 40 (accommodating the valve 40 while maintaining a gap for the flow of the fluid). The communication passages 31, 33, 34 are each arranged in a radial shape in a circumferential direction, and are formed in a plural number (for example, four passages at intervals of 90°).

A bearing surface 35*a* on which a first valve part 41 of the below-described valve body 40 is seated is formed on an edge part of the communication passage (valve hole) 32 in the first valve chamber 35, and a bearing surface 36*a* on which a second valve part 42 of the below-described valve body 40 is seated is formed on an end part of a below-described fixed iron core 64.

The valve body 40 is formed in a substantially cylindrical shape, and is provided with the first valve part 41 on one end, the second valve part 42 on the other end, a third valve part 43 linked by being mounted on the side opposite to the second valve part 42 across from the first valve part 41, the communication passage 44 passing through from the second valve part 42 to the third valve part 43 in the axial direction and functioning as a suction-side passage, and the like.

The third valve part 43 is formed in a fan shape spreading from a state of reduced diameter from the first valve chamber 35 toward the third valve chamber 38 to accommodate the communication passage (valve hole) 32, and is provided with an annular engaging surface 43*a* facing a below-described adapter 53 on the outside peripheral edge of the third valve part (refer to FIG. 3).

Figure 3:
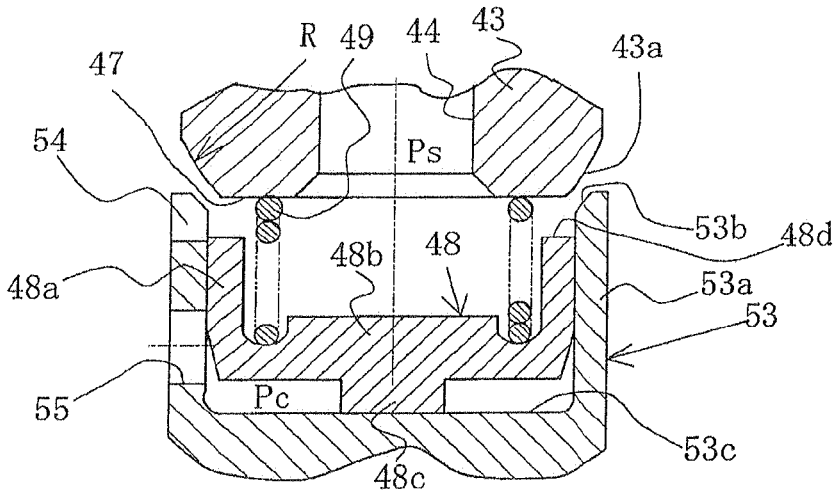
FIG. 3 is a partial enlarged cross-sectional view showing part of the capacity control valve in enlarged form, where (a) shows a state in which the pressure-sensitive body is constricted by the pressure of the control chamber, the third valve part and the adapter are opened, and the valve body for discharging the liquid refrigerant is also opened, (b) shows a state in which the pressure-sensitive body is elongated and the third valve part and the adapter are closed, but the valve body for discharging the liquid refrigerant is opened, and (c) shows a state in which the pressure-sensitive body is elongated, the third valve part and the adapter are closed, and the valve body for discharging the liquid refrigerant is also closed.
Figure 3:
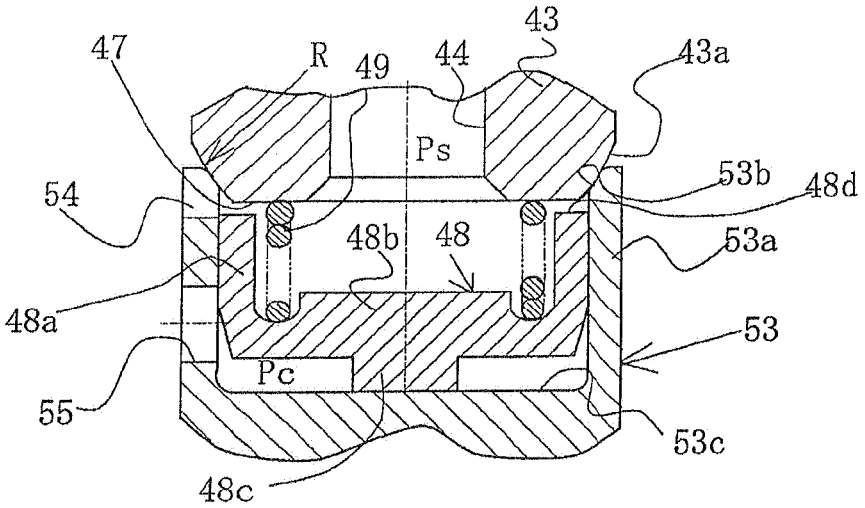
Figure 3:
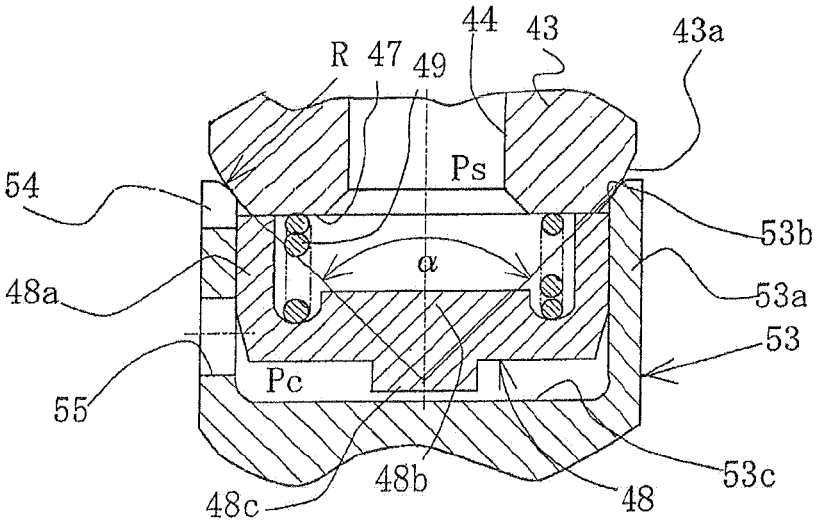

Here, the engaging surface 43*a* of the third valve part 43 with the adapter 53 is formed in a spherical shape having an outward convexity and a radius of curvature R, as shown in FIG. 3. An end face 47, which is the surface engaging with a below-described valve body 48 for discharging the liquid refrigerant, is formed in a planar shape.

In FIG. 2, the pressure-sensitive body 50 is provided with a bellows 51, the adapter 53, and the like. One end of the bellows 51 is fixed to the blocking member 39, and the other end (free end) holds the adapter 53.

The adapter 53 is provided with a hollow cylindrical part 53*a* having a substantial U-shape in cross section and engaging via the distal end thereof with the third valve part 43, and is also provided with an annular bearing surface 53*b* that has a protrusion extending into the bellows 51 and can engage with and disengage from the engaging surface 43*a* of the third valve part 43 in a facing arrangement at the distal end of the hollow cylindrical part 53*a*, as shown in FIGS. 2 and 3. The bearing surface 53*b* of the hollow cylindrical part 53*a* is formed in a tapered planar shape having a central angle $\alpha$ (refer to FIG. 3(*c*)).

Specifically, the pressure-sensitive body 50 is disposed in the third valve chamber 38 and operates so as to exert an urging force in a direction for opening the first valve part 41 by elongation (expansion), and undergo constriction in accordance with an increase in the surrounding pressure (inside the communication passage 44 of the third valve chamber 38 and the valve body 40) to reduce the urging force exerted on the first valve part 41.

FIG. 3 is a partial enlarged cross-sectional view showing part of the capacity control valve in enlarged form, where (a) shows a state in which the pressure-sensitive body 50 is constricted by the pressure of the control chamber, the third valve part 43 and the adapter are opened, and the valve body 48 for discharging the liquid refrigerant is also opened, (b) shows a state in which the pressure-sensitive body 50 is elongated and the third valve part 43 and the adapter 53 are closed, but the valve body 48 for discharging the liquid refrigerant is opened, and (c) shows a state in which the pressure-sensitive body 50 is elongated, the third valve part 43 and the adapter 53 are closed, and the valve body 48 for discharging the liquid refrigerant is also closed.

As shown in FIGS. 3(*a*), 3(*b*), and 3(*c*), the valve body 48 for discharging the liquid refrigerant is provided so as to fit inside the hollow cylindrical part 53*a* of the adapter 53 while being able to slide in the axial direction; a slit 54 that has an aperture surface area s4 and opens in the axial direction is provided to the distal end (part in engagement with the third valve part 43) of the hollow cylindrical part 53*a* of the adapter 53; and a hole 55 for introducing pressure into the control chamber is provided to the base part 53*c* of the adapter.

The valve body 48 for discharging the liquid refrigerant has a cylinder part 48*a* and a bottom part 48*b* fitted with the interior surface of the hollow cylindrical part 53*a* of the adapter 53; a protrusion 48*c* is provided facing the exterior in the center of the bottom part 48*b*; a space is formed between the base part 53*c* of the adapter 53 and the bottom part 48*b*; and control chamber pressure Pc from the hole 55 for introducing pressure into the control chamber is introduced into the space. The valve body 48 for discharging the liquid refrigerant is urged in the direction in which a contact surface 48*d* at the distal end of the cylinder part 48*a* is separated from the end face 47 of the third valve part 43 by a spring 49 provided at the end face 47 of the third valve part 43. The repulsive force of the spring 49 is set to a level at which the valve body 48 for discharging the liquid refrigerant closes when the set pressure difference ($\Delta p$) between Pc and Ps is reached or exceeded (specifically, the setting is established so that the repulsive force of the spring 49 is less than ΔP at the time of valve closure). In the present example, the distal end face 48*d* of the cylinder part 48*a* is formed in a planar shape orthogonal to the central axis direction, and is parallel to the end face 47 of the third valve part 43. Moreover, the slit 54 of the adapter 53 is completely open in a state in which the valve body 48 for discharging the liquid refrigerant is opened to the maximum extent.

Figure 6:
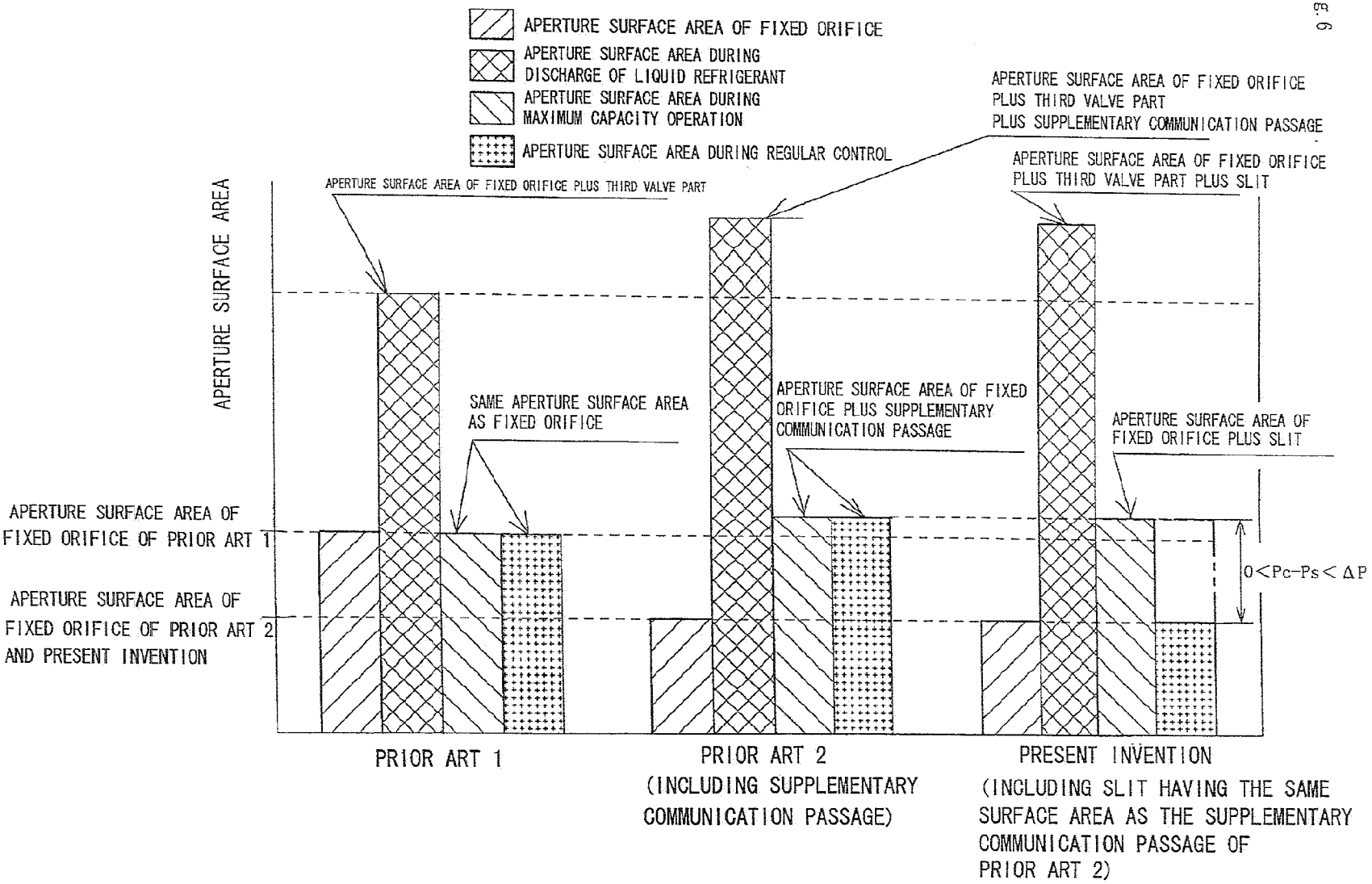
FIG. 6 is an explanatory view describing the aperture surface area of the control chamber as well as the fixed orifice and the communication passage (suction-side passage) in Prior Art 1, Prior Art 2, and the present invention.

The fixed orifice 19 of the present embodiment (present invention) is set to the same aperture surface area as the aperture surface area s1 of the fixed orifice of Prior Art 2, and the surface area s4 of the slit is set to the same aperture surface area as the aperture surface area s3 of the supplementary communication passage of Prior Art 2, as shown in FIG. 6. The aperture surface area of the third valve part 43 and the adapter 53 is set to the same surface area s2 as that of Prior Art 2.

Accordingly, in the present embodiment, the aperture surface area during the discharge of the liquid refrigerant is the same s1+s2+s4 as the aperture surface area of Prior Art 2, and the aperture surface area during maximum capacity operation (when the control chamber pressure Pc and the suction pressure Ps are substantially the same) is the same s1+s4 as the aperture surface area of Prior Art 2 because a state is maintained in which the valve body 48 for discharging the liquid refrigerant is opened.

However, in the present embodiment, the aperture surface area during regular control is a surface area in which the valve body 48 for discharging the liquid refrigerant operates in the closing direction when the pressure difference between the control chamber pressure Pc and the suction pressure Ps approaches ΔP, as shown in FIG. 6, and the surface area s1 of the fixed orifice is added to the aperture surface area of the slit in a state in which the pressure difference between the control chamber pressure Pc and the suction pressure Ps is in equilibrium with the repulsive force of the spring 49 (FIG. 3(*b*)). The aperture surface area during regular control is therefore reduced as the pressure difference between Pc and Ps approaches ΔP, as shown in FIG. 6. When the pressure difference between the control chamber pressure Pc and the suction pressure Ps exceeds ΔP, a state is produced in which the valve body 48 for discharging the liquid refrigerant is completely closed (FIG. 3(*c*)). The aperture surface area during minimum capacity operation is such that the pressure difference between the control chamber pressure Pc and the suction pressure Ps is much greater than ΔP. A state is therefore reached in which the valve body 48 for discharging the liquid refrigerant is completely closed, and the aperture surface area of the fixed orifice is established.

Figure 7:
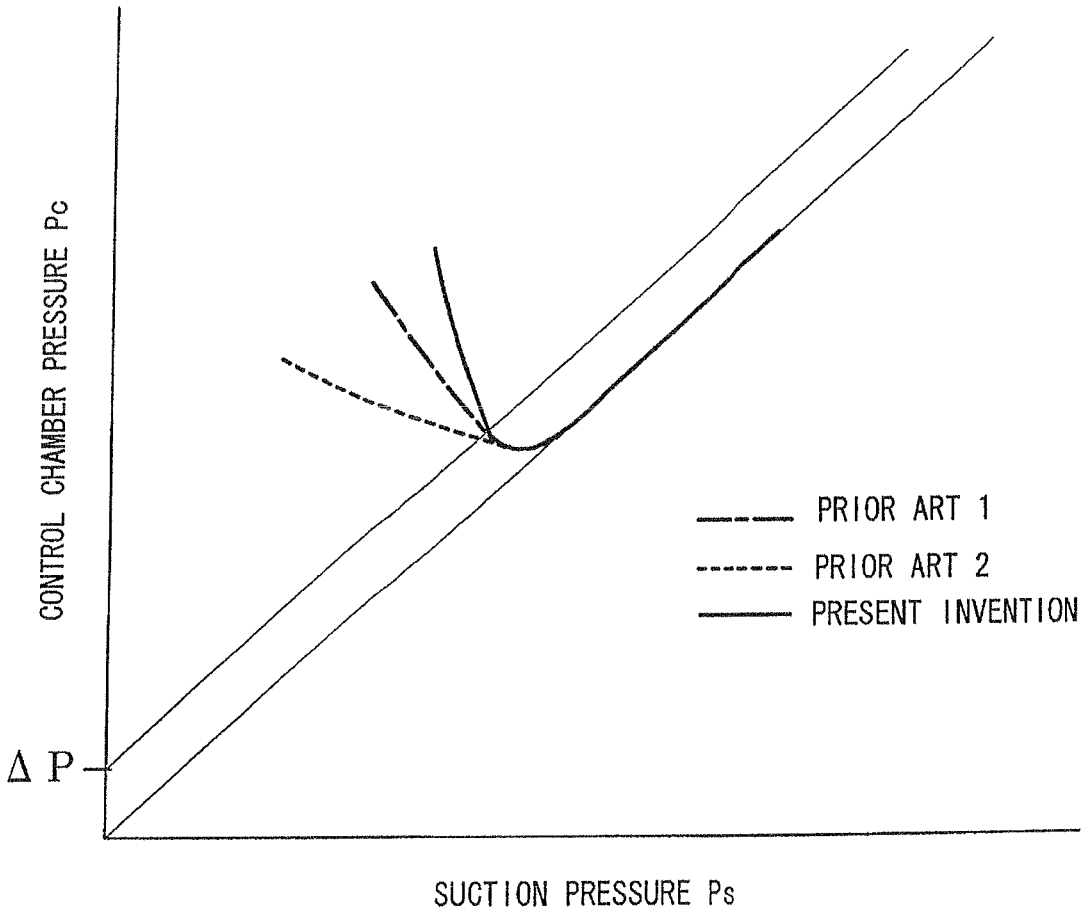
FIG. 7 is a view describing the responsiveness of the control chamber pressure Pc to fluctuations of the suction chamber pressure Ps in Prior Art 1, Prior Art 2, and the present invention.
Figure 8:
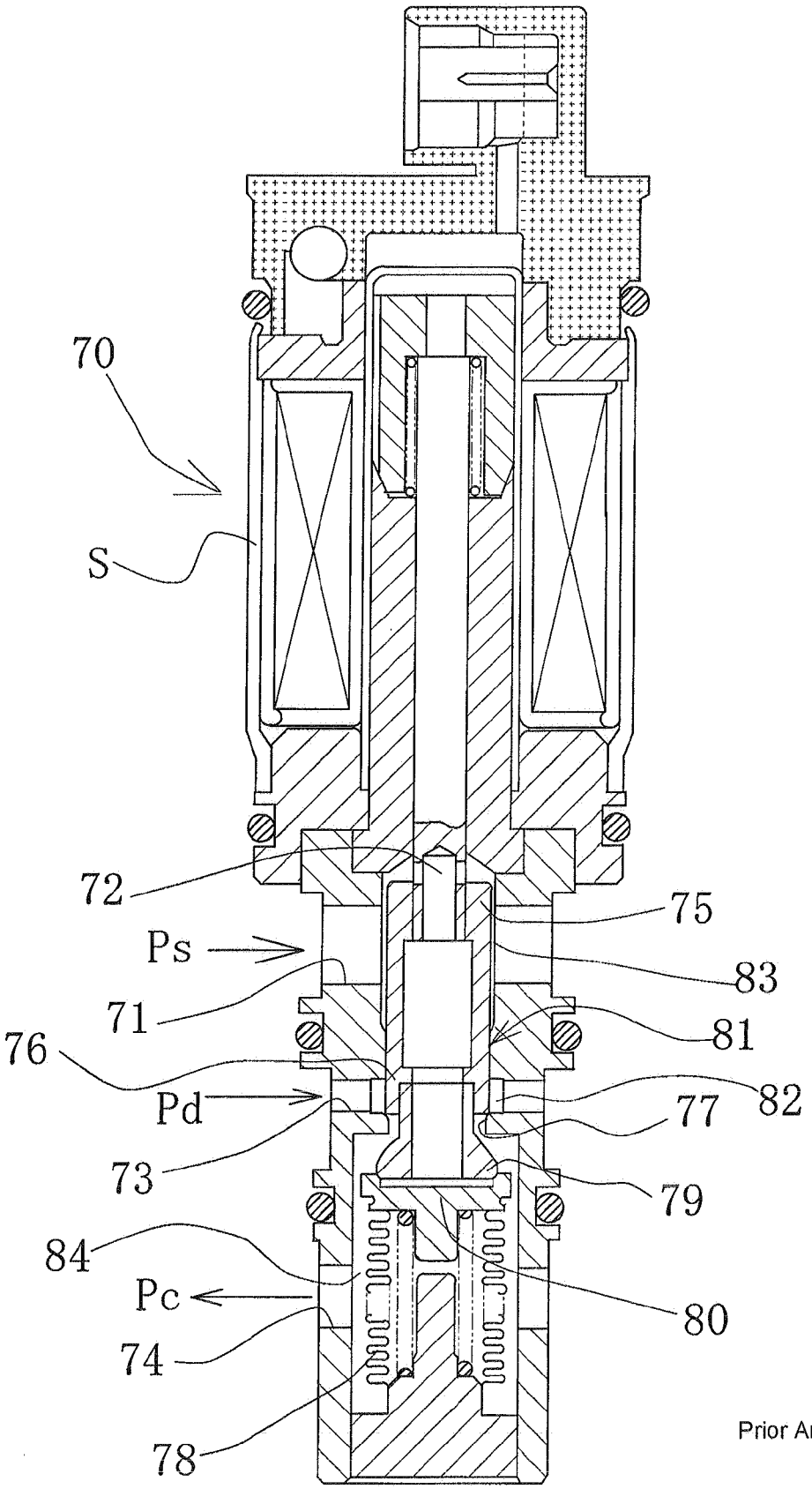
FIG. 8 is a front cross-sectional view showing the capacity control valve of Prior Art 1.
Figure 9:
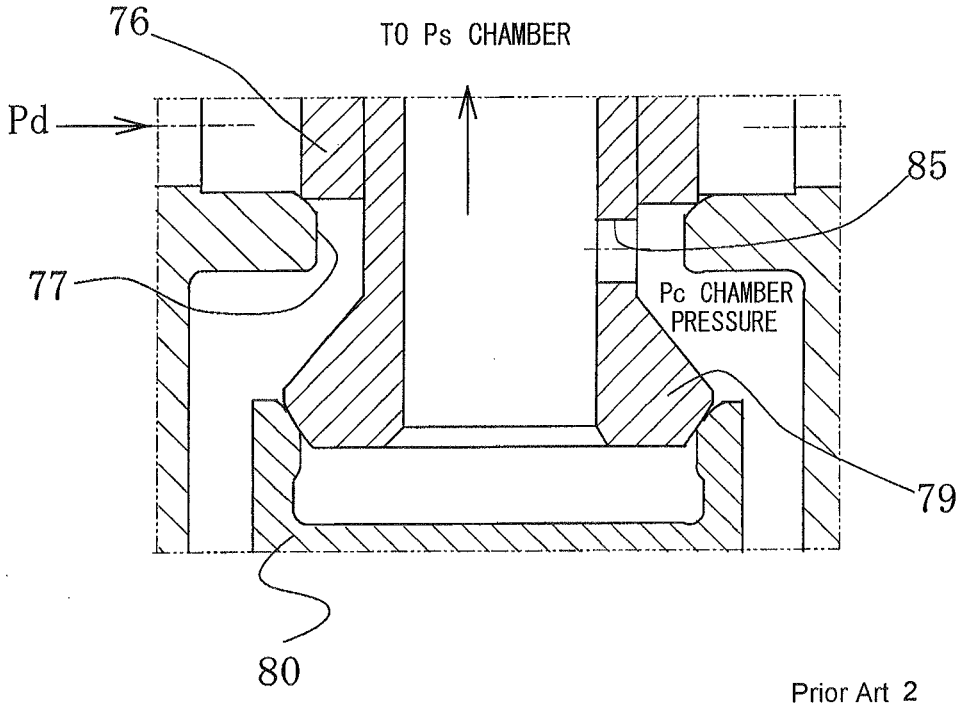
FIG. 9 is a partial cross-sectional view showing the capacity control valve of Prior Art 2.

According to the present embodiment, the aperture surface area during the discharge of the liquid refrigerant is increased to the same surface area as that of Prior Art 2, and an enhanced state can be maintained for the function to discharge the liquid refrigerant in the control chamber during startup and an enhanced state can be maintained for the pressure discharge efficiency during maximum capacity. In addition, the aperture surface area during regular control and minimum capacity operation can be reduced to the aperture surface area of the fixed orifice. The control chamber pressure Pc can therefore be highly responsive to the change in suction pressure Ps, and the control speed of the swash plate during regular control and minimum capacity operation can be improved, as shown by the solid line in FIG. 7. Also in the present embodiment, the aperture surface area of the fixed orifice is made the same as the surface area of the fixed orifice in Prior Art 2, and the aperture surface area of the slit is made the same as the aperture surface area of the supplementary communication passage, but the function of discharging the liquid refrigerant and the function during regular control can be appropriately changed by increasing and decreasing the diameter (aperture surface area) of the fixed orifice and the aperture surface area of the slit.

The solenoid 60 is provided with a casing 62 linked to the body 30, a sleeve 63 in which one end part is closed, a cylindrical fixed iron core 64 disposed inside the casing 62 and the sleeve 63, a drive rod 65 disposed in the fixed iron core 64 in a reciprocating manner and arranged so that the distal end of the drive rod is linked to the valve body 40 to form the communication passage 44, a moveable iron core 66 fixedly attached to the other end of the drive rod 65, a coil spring 67 for urging the moveable iron core 66 in the direction that opens the first valve part 41, an excitation coil 68 wound on the outside of the sleeve 63 via a bobbin, and the like, as shown in FIG. 2.

In the above-described structure, in a state in which the coil 68 is unpowered, the valve body 40 is moved upward in FIG. 2 by the urging force of the pressure-sensitive body 50 and the coil spring 67, the first valve part 41 is separated from the bearing surface 35*a* to open the communication passages (discharge-side passages) 31, 32, at the same time as the second valve part 42 rests on the bearing surface 36*a* to block the communication passages (suction-side passages) 34, 44.

When the variable capacity compressor is left in a stopped state for a long time while the communication passages (suction-side passages) 34, 44 are blocked, a state arises in which the liquid refrigerant accumulates in the control chamber (crank chamber) 12 of the variable capacity compressor, the interior of the variable capacity compressor achieves a uniform pressure, and the control chamber pressure Pc rises substantially above the control chamber pressure Pc and the suction pressure Ps during operation of the variable capacity compressor.

When the coil 68 is powered above a preset electric current value (I), the valve body 40 is moved downward in FIG. 2 by the electromagnetic driving force (urging force) of the solenoid 60 operating in the opposite direction to the urging force of the pressure-sensitive body 50 and the coil spring 67, and the first valve part 41 rests on the bearing surface 35*a* to block the communication passages (discharge-side passages) 31, 32 at the same time as the second valve part 42 separates from the bearing surface 36*a* to open the communication passages (suction-side passages) 34, 44. The liquid refrigerant in the control chamber is discharged immediately following the startup, but the bellows 51 is constricted because the control chamber pressure Pc reaches or surpasses a preset level. As shown in FIG. 3(*a*), the adapter 53 disengages from the third valve part 43, the valve body 48 for discharging the liquid refrigerant is opened, and a state is therefore established in which the suction-side passages (33, 44, 34) are opened. The liquid refrigerant and the like accumulated in the control chamber 12 are discharged to the suction chamber 13 by way of the communication passages (suction-side passages) 33, 44, 34. At this time, the size of the discharge passage for the liquid refrigerant and the like can be determined by adding the aperture surface area s2 of the engaging surface 43*a* of the third valve part 43 with the bearing surface 53*b* of the adapter 53, as well as the surface area s4 of the slit 54 of the adapter 53, to the aperture surface area s1 of the fixed orifice 19 to make the surface area of the discharge passage sufficiently large.

The bellows 51 elongates when the liquid refrigerant and the like in the control chamber are discharged and the control chamber pressure Pc reaches or surpasses a preset level. The third valve part 43 rests on the bearing surface 53*b* of the adapter 53, as shown in FIG. 3(*b*). In this state, the control chamber pressure Pc is greater than the suction pressure Ps, and the difference between Pc and Ps is less than ΔP. The valve body 48 for discharging the liquid refrigerant therefore operates in the closing direction, the repulsive force of the spring 49 gradually increases, and the valve body 48 for discharging the liquid refrigerant engages with the third valve part 43 and reaches a closed state when the difference between the control chamber pressure Pc and the suction pressure Ps exceeds ΔP, as shown in FIG. 3(*c*).

In the above-described structure, the formula for the equilibrium relationship of the force acting on the valve body 40 is as shown below, where Ab is the pressure-receiving surface area at the effective diameter of (the bellows 51 of) the pressure-sensitive body 50, Ar1 is the pressure-receiving surface area at the seal diameter of the third valve part 43, As is the pressure-receiving surface area at the seal diameter of the first valve part 41, Art is the pressure-receiving surface area at the seal diameter of the second valve part 42, Fb is the urging force of the pressure-sensitive body 50, Fs is the urging force of the coil spring 67, Fsol is the urging force due to the electromagnetic driving force of the solenoid 60, Pd is the discharge pressure of the discharge chamber 11, Ps is the suction pressure of the suction chamber 13, and Pc is the control chamber pressure of the control chamber (crank chamber) 12, as shown in FIG. 2.

$$Pc\cdot(Ab-Ar1)+Pc\cdot(Ar1-As)+Ps\cdot Ar1+Ps\cdot(Ar2-Ar1)+Pd\cdot(As-Ar2)=Fb+Fs-Fso1$$

In the above-described structure, the pressure-receiving surface area Ab of the pressure-sensitive body 50 and the pressure-receiving surface area Ar1 of the third valve part 43 are formed in the same manner, as are the pressure-receiving surface area As of the first valve part 41 and the pressure-receiving surface area Ar2 of the second valve part 42, and the pressure-receiving surface area Ar1 of the third valve part 43 and the pressure-receiving surface area As of the first valve part 41.

Specifically, the control chamber pressure Pc acting on the pressure-sensitive body 50 in the third valve chamber 38 can be canceled out by making the pressure-receiving surface area Ab and the pressure-receiving surface area Ar1 equal. The effect of the pressure can be prevented, the valve body 40 can operate without being affected by the control chamber pressure Pc, and capacity can be controlled in a stable manner.

In addition, the discharge pressure Pd acting on the valve body 40 can be canceled out by making the pressure-receiving surface area As and the pressure-receiving surface area Ar2 equal to each other. The effect of the pressure can be prevented, the valve body 40 can operate without being affected by the discharge pressure Pd, and capacity can be controlled in a stable manner.

An operation in which the variable capacity swash plate compressor M provided with the capacity control valve V is applied to an air-conditioning system of a motor vehicle is described below.

The rotating shaft 20 is first rotated via a transmission belt (not shown) and the driven pulley 24 by the rotary driving force of the engine, whereupon the swash plate 21 rotates integrally with the rotating shaft 20. When the swash plate 21 rotates, the piston 22 reciprocates in the cylinder 14 at a stroke corresponding to the angle of inclination of the swash plate 21, and a coolant gas drawn into the cylinder 14 from the suction chamber 13 is compressed by the piston 22 and discharged to the discharge chamber 11. The discharged coolant gas is supplied to the evaporator 27 from the condenser 25 via the expansion valve 26, and the gas returns to the suction chamber 13 while a cooling cycle is performed.

Here, the discharge rate of the coolant gas is determined by the stroke of the piston 22, and the stroke of the piston 22 is determined by the angle of inclination of the swash plate 21 controlled by the pressure inside the control chamber 12 (control chamber pressure Pc).

During compression of the piston 22, blowby gas from the clearance between the piston 22 and the cylinder 14 constantly flows toward the control chamber 12 and causes the pressure Pc of the control chamber 12 to increase. However, pressure discharge occurs at a constant rate from the control chamber 12 to the suction chamber even when the communication passages (suction-side passages) 33, 44, 34 are closed because a fixed orifice 19 is provided. The aperture surface area during maximum capacity operation is therefore preferably large.

When the solenoid 60 is first turned off and the variable capacity compressor is left in a stopped state for a long time period of time while the second valve part 42 is blocking the communication passages (suction-side passages) 34, 44, a state arises in which the liquid refrigerant accumulates in the control chamber 12, the interior of the variable capacity compressor achieves a uniform pressure, and the control chamber pressure Pc rises substantially above the control chamber pressure Pc and the suction pressure Ps during driving of the variable capacity compressor.

When the solenoid 60 is turned on and the valve body 40 is started up in this state, the first valve part 41 moves in the closing direction at the same time as the second valve part 42 moves in the opening direction. The liquid refrigerant in the control chamber is discharged immediately following the startup, but the bellows 51 is constricted because the control chamber pressure Pc reaches or surpasses a preset level. As shown in FIG. 3(*a*), the adapter 53 disengages from the third valve part 43, the valve body 48 for discharging the liquid refrigerant is opened, and a state is therefore established in which the suction-side passages are opened. The liquid refrigerant and the like accumulated in the control chamber 12 are discharged to the suction chamber 13 by way of the communication passages (suction-side passages) 44, 34. In the process of discharging the liquid refrigerant, the suction pressure Ps and the control chamber pressure Pc are both reduced. When the discharge of the liquid refrigerant inside of the control chamber 12 is finished and the control chamber pressure Pc reaches of decreases below a preset level, the pressure-sensitive body 50 elastically recovers and elongates. As shown in FIG. 3(*b*), the adapter 53 engages with the third valve part 43. In this state, the control chamber pressure Pc is greater than the suction pressure Ps, the difference between Pc and Ps is less than ΔP, and a state is therefore established in which the valve body 48 for discharging the liquid refrigerant is opened.

In this discharge process, the engaging surface 43*a* of the third valve part 43 is formed in a spherical shape having a radius of curvature R, and the bearing surface 53*b* of the adapter 53 is formed in a tapered planar shape having a central angle α. The liquid refrigerant can therefore be efficiently discharged, and quick movement to the desired capacity control is possible.

In an operating state having a maximum discharge rate, the solenoid 60 (coil 68) is powered by a preset electric current (I), the moveable iron core 66 and the drive rod 65 act against the urging force of the pressure-resistant body 50 and the coil spring 67, and the valve body 40 moves to a position in which the first valve part 41 rests on the bearing surface 35*a* to block the communication passages (discharge-side passages) 31, 32, and the second valve part 42 is separated from the bearing surface 36*a* to open the communication passages (suction-side passages) 34, 44.

The pressure-sensitive body 50 elastically recovers and elongates because the control chamber pressure Pc reaches or decreases below a preset level, and the adapter 53 engages with the third valve part 43.

The control chamber pressure Pc inside the control chamber 12 and the suction pressure Ps are substantially the same; specifically, the difference between Pc and Ps is less than ΔP. As shown in FIG. 3(*b*), the contact surface 48*d* at the distal end of the cylinder part 48*a* of the valve body 48 for discharging the liquid refrigerant is separated from the end face 47 of the third valve part 43 and caused to establish an open state by the urging force of the spring 49 provided at the end face 47 of the third valve part 43, and the fluid inside the control chamber 12 is discharged to the suction chamber 13 through the communication passages (suction-side passages) 33, 44, 34 via the slit 54 of the adapter 53. The angle of inclination of the swash plate 21 is thereby quickly controlled so as to be increased to the maximum, and the stroke of the piston 22 is set to the maximum. As a result, the discharge rate of the liquid gas reaches the maximum.

During regular control (between maximum capacity operation and minimum capacity operation), the magnitude of the electric power provided to the solenoid 60 (coil 68) is appropriately controlled to vary the electromagnetic driving force (urging force). Specifically, the position of the valve body 40 is appropriately adjusted by the electromagnetic driving force, and the opening rate of the first valve part 41 and the opening rate of the second valve part 42 are controlled so as to attain the desired discharge rate. In this state, the suction pressure Ps is smaller than the control chamber pressure Pc, and the valve body 48 for discharging the liquid refrigerant is operated in the closing direction (the aperture surface area during regular control in FIG. 6 is reduced) as the pressure difference between Pc and Ps approaches ΔP, as shown in FIG. 3(*b*). The valve body 48 for discharging the liquid refrigerant then engages with the third valve part 43 to establish a closed state when the pressure difference between Pc and Ps is above ΔP, as shown in FIG. 3(*c*).

In addition, in a minimum capacity operation state, the solenoid 60 (coil 68) is unpowered, and the moveable iron core 66 and the drive rod 65 are retracted and stopped in a resting position by the urging force of the coil spring 67. The valve body 40 is moved to a position in which the first valve part 41 is separated from the bearing surface 35*a* to open the communication passages (discharge-side passages) 31, 32, and the second valve part 42 rests on the bearing surface 36*a* to close the communication passages (suction-side passages) 34, 44. The discharge fluid (discharge pressure Pd) is thereby supplied inside the control chamber 12 through the communication passages (discharge-side passages) 31, 32, 33. The angle of inclination of the swash plate 21 is then controlled so as to be greatly reduced, and the stroke of the piston 22 reaches the minimum. As a result, the discharge rate of the coolant gas is at the minimum. In this state, the control chamber pressure Pc is large and the suction pressure Ps is small, and the pressure difference between Pc and Ps is therefore large. As shown in FIG. 3(*c*), the valve body 48 for discharging liquid refrigerant engages with the third valve part 43 to establish a closed state.

During regular control, the aperture surface area of the communication passages (33, 44, 34) can thus be reduced to substantially the same surface area as that of the fixed orifice, and the control speed of the swash plate during regular control and minimum capacity operation can be increased because the communication passages (33, 44, 34) can be blocked during minimum capacity operation.

Figure 4:
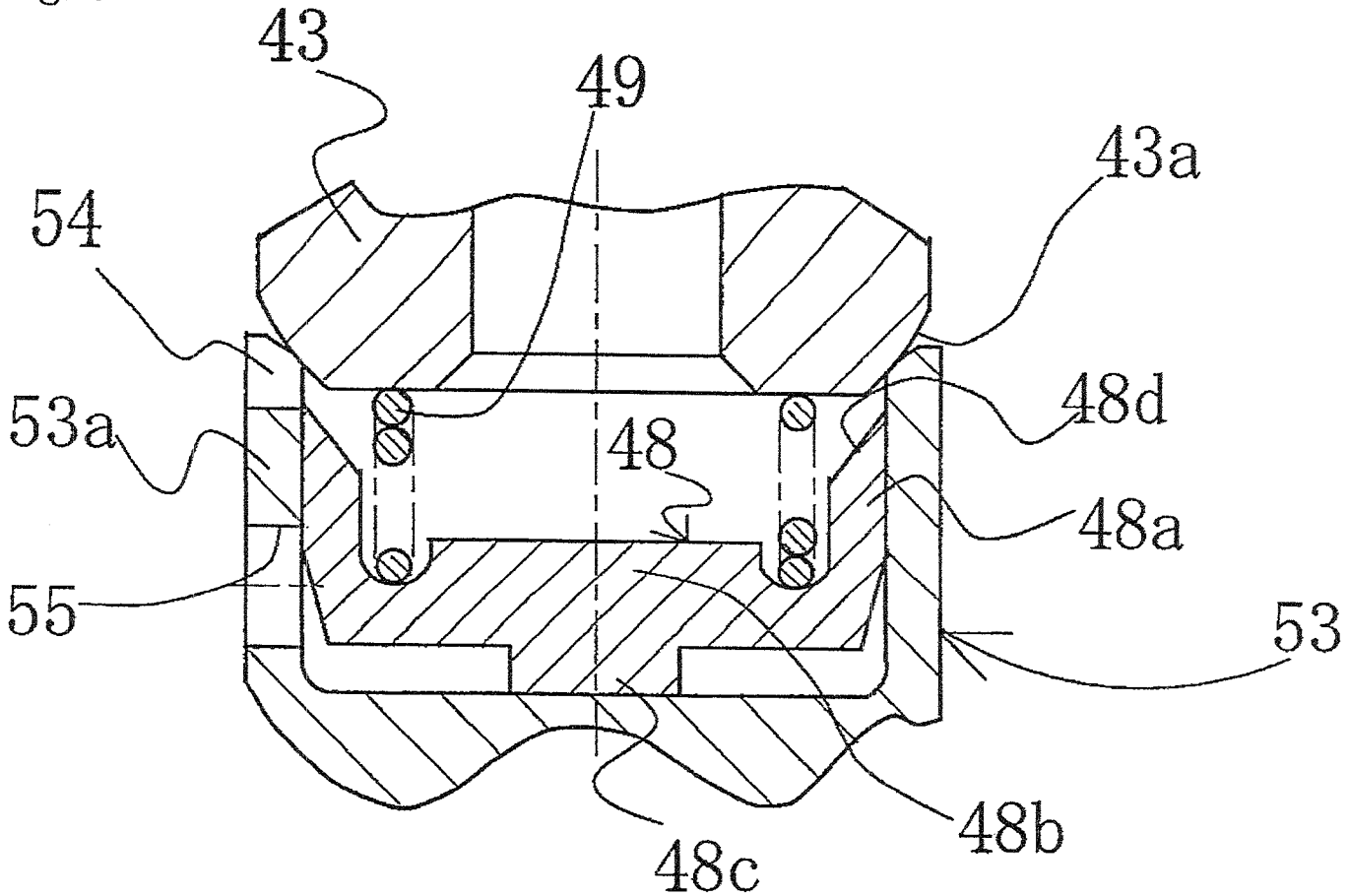
FIG. 4 is a partial enlarged cross-sectional view of another embodiment of the capacity control valve.

FIG. 4 is a partial cross-sectional view showing another embodiment of the valve body 48 for discharging the liquid refrigerant.

The members in FIG. 4 having the same alphanumeric symbols as those in FIG. 3 are the same members as those in FIG. 3, and a detailed description thereof is omitted.

In the present example, the contact surface 48*d* at the distal end of the cylinder part 48*a* of the valve body 48 for discharging the liquid refrigerant is formed in a shallow shape that tapers off in the direction from the outside periphery toward the inside periphery. The seal diameter of both the contact surface 48*d* and the spherical engaging surface 43*a* of the third valve part 43 can therefore be adjusted.

Figure 5:
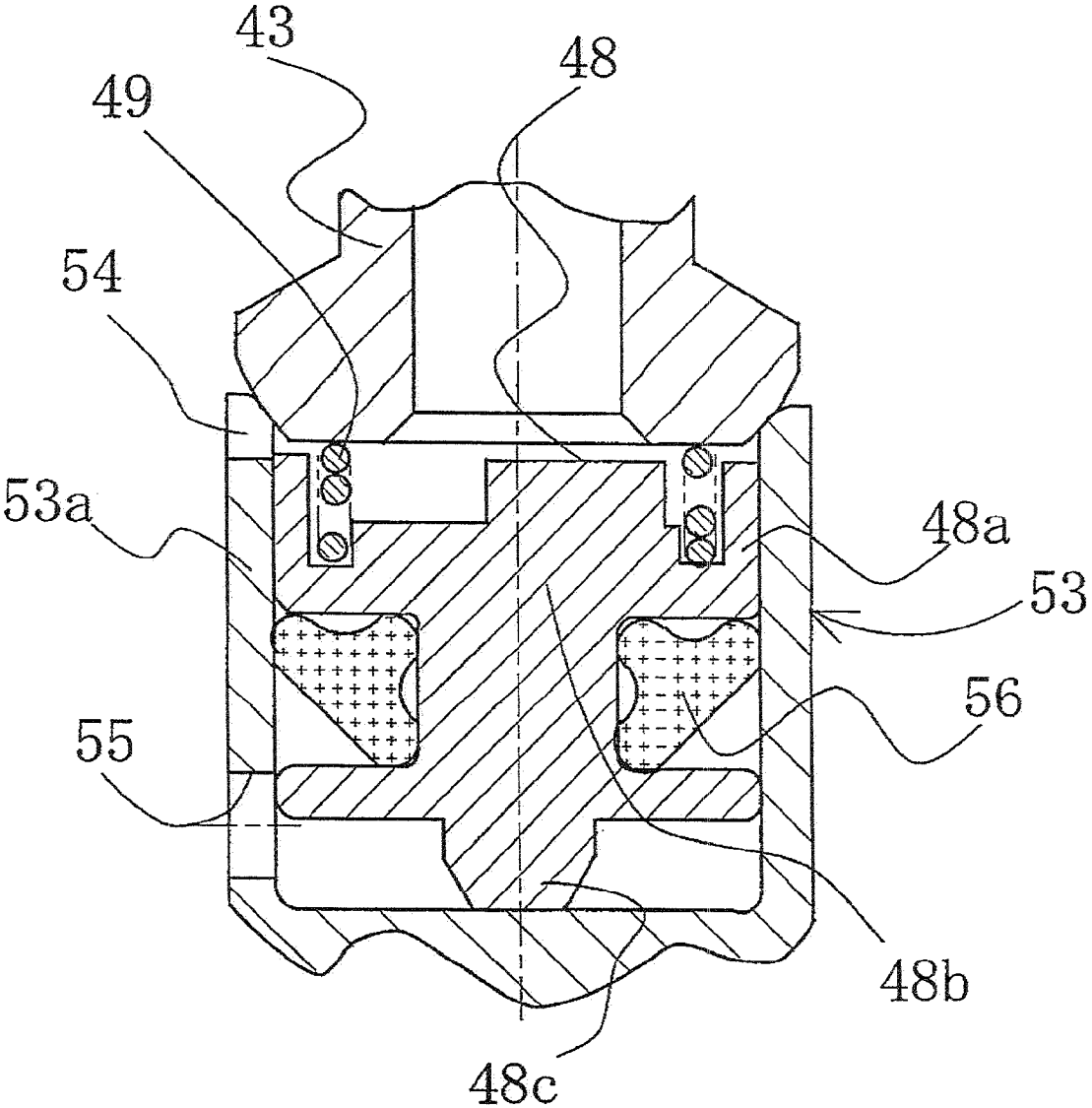
FIG. 5 is a partial enlarged cross-sectional view of yet another embodiment of the capacity control valve.

FIG. 5 is a partial cross-sectional view showing yet another embodiment of the valve body 48 for discharging the liquid refrigerant.

The members in FIG. 5 having the same alphanumeric symbols as those in FIG. 3 are the same members as those in FIG. 3, and a detailed description thereof is omitted.

In the present example, the structure is such that a Y-ring 56 is mounted to the external periphery of the valve body 48 for discharging the liquid refrigerant, and the effect of the pressure difference between the control chamber pressure Pc and the suction chamber pressure Ps can be applied to the maximum extent by forming a secure seal between the valve body 48 for discharging the liquid refrigerant and the inner surface of the hollow cylindrical part 53*a* of the adapter 53. Mounting the Y-ring 56 allows the bottom part 48*b* of the valve body 48 for discharging the liquid refrigerant to be extended in the axial direction, and a circular channel for mounting the Y-ring 56 to be provided.

[KEY]

10 Casing
11 Discharge chamber
12 Control chamber (crank chamber)
13 Suction chamber
14 Cylinder
15 Communication passage
16 Communication passage
17 Communication passage
18 Communication passage
19 Fixed orifice
20 Rotating shaft
21 Swash plate
22 Piston
23 Linking member
24 Driven pulley
25 Condenser (condensing device)
26 Expansion valve
27 Evaporator (evaporating device)
30 Body
31, 32 Communication passage (discharge-side passage)
33 Communication passage (control chamber-side passage)
34 Communication passage (suction-side passage)
35 First valve chamber
35*a* Bearing surface
36 Second valve chamber
36*a* Bearing surface
37 Guide passage
38 Third valve chamber
39 Blocking member
40 Valve body
41 First valve part
42 Second valve part

43 Third valve part
43*a* Engaging surface
44 Communication passage
47 End face of third valve part 3
48 Valve body for discharging liquid refrigerant
48*a* Cylinder part
48*b* Bottom part
48*c* Protrusion
48*d* Contact surface
49 Spring
50 Pressure-sensitive body
51 Bellows
53 Adapter
53*a* Hollow cylindrical part
53*b* Bearing surface
53*c* Base part
54 Slit
55 Hole for introducing pressure into control chamber
56 Y-ring
60 Solenoid
62 Casing
63 Sleeve
64 Fixed iron core
65 Drive rod
66 Moveable iron core
67 Coil spring
68 Excitation coil
M Variable capacity swash plate compressor
V Capacity control valve
Pd Discharge pressure
Ps Suction pressure
Pc Control chamber pressure
Ab Pressure-receiving surface area of pressure-sensitive body
Ar1 Pressure-receiving surface area of third valve part
As Pressure-receiving surface area of first valve part
Ar2 Pressure-receiving surface area of second valve part

The invention claimed is:

1. A capacity control valve comprising:

a discharge-side passage for providing communication between a discharge chamber for discharging a fluid and a control chamber for controlling a discharge rate of the fluid;

a first valve chamber formed in a middle of said discharge-side passage;

a suction-side passage for providing communication between a suction chamber for drawing in the fluid and said control chamber;

a second valve chamber formed in a middle of said suction-side passage;

a valve body integrally having a first valve part for opening and closing said discharge-side passage in said first valve chamber and a second valve part for opening and closing said suction-side passage in said second valve chamber, and performing an operation in which opening and closing occur opposite to each other by reciprocation thereof;

a third valve chamber formed nearer to said control chamber and away from said second valve chamber in the middle of said suction-side passage;

a pressure-sensitive body disposed in said third valve chamber, said pressure-sensitive body exerting an urging force in a direction for opening said first valve part by elongation, and undergoing constriction in accordance with an increase in a surrounding pressure;

an adapter provided to a free end of said pressure-sensitive body in the elongation and constriction direction, said adapter having an annular bearing surface;

a valve body for discharging a liquid refrigerant, moveably provided inside the adapter;

a third valve part having an annular engaging surface for integrally moving with said valve body in said third valve chamber and opening and closing said suction-side passage by engagement with and disengagement from the bearing surface of said adapter and the valve body for discharging the liquid refrigerant; and a solenoid for exerting an electromagnetic driving force on said valve body in a direction for closing said first valve part;

wherein a slit is provided to an engaging part of said adapter with the third valve part, an introduction hole for causing the control chamber pressure to act on a bottom surface of said valve body for discharging the liquid refrigerant is provided to the base part side, and an urging force is provided whereby said valve body for discharging the liquid refrigerant is urged in a valve-opening direction away from the third valve part.

2. The capacity control valve according to claim 1, wherein a contact surface that the valve body for discharging the liquid refrigerant has with the third valve part is formed in a tapered shape.

3. The capacity control valve according to claim 1, wherein a Y-ring is mounted to an external periphery of the valve body for discharging the liquid refrigerant, and the space between the valve body and the inner surface of the adapter is sealed.

4. The capacity control valve according to claim 2, wherein a Y-ring is mounted to an external periphery of the valve body for discharging the liquid refrigerant, and the space between the valve body and the inner surface of the adapter is sealed.

* * * * *